US007437095B2

(12) United States Patent
Shimomura et al.

(10) Patent No.: US 7,437,095 B2
(45) Date of Patent: Oct. 14, 2008

(54) IMAGE FORMING APPARATUS AND TONER CARTRIDGE

(75) Inventors: Tatsuhiko Shimomura, Tokyo (JP); Atsushi Ota, Tokyo (JP)

(73) Assignee: Oki Data Corporation, Tokyo (JP)

( * ) Notice: Subject to any disclaimer, the term of this patent is extended or adjusted under 35 U.S.C. 154(b) by 158 days.

(21) Appl. No.: 11/142,276

(22) Filed: Jun. 2, 2005

(65) Prior Publication Data

US 2005/0271425 A1 Dec. 8, 2005

(30) Foreign Application Priority Data

Jun. 4, 2004 (JP) ..... 2004-167053
Mar. 28, 2005 (JP) ..... 2005-092387

(51) Int. Cl.
*G03G 15/04* (2006.01)

(52) U.S. Cl. ..... 399/119; 399/120; 399/258

(58) Field of Classification Search ..... 399/113, 399/114, 120
See application file for complete search history.

(56) References Cited

U.S. PATENT DOCUMENTS 6,496,671 B2 * 12/2002 Nakajima ..... 399/120

FOREIGN PATENT DOCUMENTS

JP 11-133713 5/1999
JP 2002-072657 3/2002

* cited by examiner

*Primary Examiner*—David M. Gray
*Assistant Examiner*—David A Blackshire
(74) *Attorney, Agent, or Firm*—Rabin & Berdo, PC

(57) ABSTRACT

A toner cartridge is detachably attached to an image forming apparatus and supplies toner to the image forming apparatus. The locking mechanism is positioned either at a locking position or at a non-locking position. Shortly after the toner cartridge has been attached to the image forming apparatus, the locking mechanism is at a non-locking position. When a user operates a driving member of the toner cartridge after the toner cartridge has been attached to the image forming apparatus, the operating lever engages the locking mechanism to cause the locking mechanism to move to a locking position. When the locking mechanism is at the locking position, the locking mechanism limits the driving member to move relative to the engagement portion, so that the toner cartridge is not allowed to be detached from the image forming apparatus.

15 Claims, 18 Drawing Sheets

IMAGE FORMING APPARATUS AND TONER CARTRIDGE

BACKGROUND OF THE INVENTION

1. Field of the Invention

The present invention relates to a toner cartridge that holds toner therein and an image-forming apparatus to which the toner cartridge is installed.

2. Description of the Related Art

Among a variety of conventional image-forming apparatus is one in which toner as a developer is supplied from a toner cartridge installed in the image-forming apparatus. The toner cartridge is detachably attached to the image-forming apparatus, and is replaced when the toner is exhausted. The toner cartridge extends in its longitudinal direction and has one end to which an operating lever is pivotally provided to open and close a shutter.

One such toner cartridge is disclosed in Japanese Patent Laid-Open No. 2002-72657. After the toner cartridge has been attached to the image-forming apparatus, a user operates an operating lever to open a shutter, thereby supplying toner from the toner cartridge into the image-forming apparatus. When the user operates the operating lever in such a direction as to open the shutter, the toner cartridge is locked to the image-forming apparatus and cannot be detached from the image-forming apparatus. When the user operates the operating lever in such a direction as to close the shutter, the toner cartridge is unlocked from the image-forming apparatus and can be detached from the image-forming apparatus.

The aforementioned conventional image-forming apparatus is simple enough for anyone to operate the operating lever to detach the toner cartridge from the image-forming apparatus. This does not imply that a particular person has permission to replace the toner cartridge. The spill of toner may be caused by the fact that an indefinite number of people cannot be prevented from replacing the toner cartridge. Moreover, the use of an unaccepted type of toner cartridge may not be prevented.

SUMMARY OF THE INVENTION

The present was made to solve the aforementioned problems.

An object of the invention is to provide a toner cartridge having a member that prevents the toner cartridge from being detached from an image forming apparatus.

A toner cartridge is detachably attached to an image-forming apparatus. Toner is supplied from the toner cartridge into the image-forming apparatus. The image forming apparatus includes an engagement portion and a locking mechanism. The engagement portion is fixedly provided on the image forming apparatus. The locking mechanism is moved either to a locking position or to a non-locking position. The locking mechanism is at a non-locking position shortly after the toner cartridge has been attached to the image forming apparatus. When a user operates a driving member of the toner cartridge after the toner cartridge has been attached to the image forming apparatus, the operating lever engages the locking mechanism to cause the locking mechanism to move to the locking position. At the locking position, the locking mechanism limits the driving member to move relative to the engagement portion so that the toner cartridge is not allowed to be detached from the image forming apparatus.

The engagement portion is a guide pin projecting from the image forming apparatus and the locking mechanism includes an urging member and a locking member urged by the urging member. When the locking mechanism is at the non-locking position, the urging member urges the locking member against the guide pin. When the driving member is moved after the toner cartridge has been attached to the image forming apparatus, the driving member causes the locking member to move out of engagement with the guide pin and then to move to the locking position.

The driving member has a first space through which a pin member is inserted into the driving member from outside of the toner cartridge to cause the locking member to move out of the locking position.

The guide pin is formed with a second space that communicates with the first space.

The operating lever has a space through which a pin member is inserted into the operating lever from outside. The pin member pushes the locking member to move out of a locking engagement with the operating lever.

A toner cartridge holds toner therein and is detachably attached to an image forming apparatus. The toner cartridge includes a driving member and a locking member. The driving member is operated to drive the toner cartridge, the driving member having a path. The locking member is slidably received in the path and moved either to a locking position where the locking member is not movable relative to the driving member or to a non-locking position where the locking member is movable relative to the operating lever. When the toner cartridge has been attached to the image forming apparatus, the locking member engages an engagement portion of the image forming apparatus. Shortly after the toner cartridge has been attached into the image forming apparatus, the locking member is at the non-locking position. When a user operates the driving member after the toner cartridge has been attached into the image forming apparatus, the locking mechanism moves to the locking position so that the locking mechanism limits movement of the driving member relative to the engagement portion so that the toner cartridge is not allowed to be detached from the image forming apparatus.

The operating lever has a space through which a pin member is inserted into the driving member from outside of the toner cartridge, the pin member pushing the locking member to move out of a locking engagement with the driving member.

A toner cartridge holds toner therein and is detachably attached to an image forming apparatus. The toner cartridge includes a driving member and a locking member. The driving member is operated to drive a toner supplying mechanism of the toner cartridge. The locking member slidably received in the driving member and movable either to a locking position where the locking member is not movable relative to the driving member or to a non-locking position where the locking member is movable relative to the operating lever. Shortly after the toner cartridge has been installed into the image forming apparatus in a first direction, the locking member is at the non-locking position. A user moves the locking member to the locking position where the locking member engages an engagement portion of the image forming apparatus. The locking mechanism limits movement of the driving member relative to the engagement portion so that the toner cartridge is not allowed to be detached from the image forming apparatus.

A toner cartridge that holds toner therein is combined with a process cartridge. The process cartridge includes a developing unit and a through-hole. The developing unit receives toner from the toner cartridge and holds the toner therein. The through-hole is formed in the developing unit. The toner cartridge includes a recess and a pin member. The recess is substantially in line with the through-hole. The pin member is inserted into the recess through the through-hole in such a way that the pin member extends through the through-hole and the recess to prevent the toner cartridge from being detached from the developing unit. The pin member has a resilient projection. When the pin member is inserted in a first direction into the through-hole and resiliently returns to its original shape, the resilient projection resiliently deforms, so that the resilient projection prevents the pin member from being pulled out of the through-hole in a second direction opposite to the first direction.

A toner cartridge that holds toner therein is combined with a process cartridge. The toner cartridge is attached into a toner cartridge receiving section of the process cartridge. A projection extends into the toner cartridge receiving section. A locking mechanism is moved either to a locking position or to a non-locking position. The toner cartridge includes a driving member movable to pivot relative to a body of the toner cartridge. The driving member includes a first path extending in a first direction and a second path communicating with the first path and extends in a second direction at an angle with the first path. When the toner cartridge is inserted into the toner cartridge receiving section in the first direction, the projection enters the first path. When the driving member is pivoted relative to the body in a third direction after the toner cartridge has been received in the toner cartridge receiving section, the projection enters the second path. Thus, the driving member causes the locking mechanism to move from the non-locking position to the locking position. At the locking position, the first path communicates with the second path, and the locking mechanism prevents the projection from entering the first path so that the toner cartridge becomes unable to move in a fourth direction opposite to the first direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
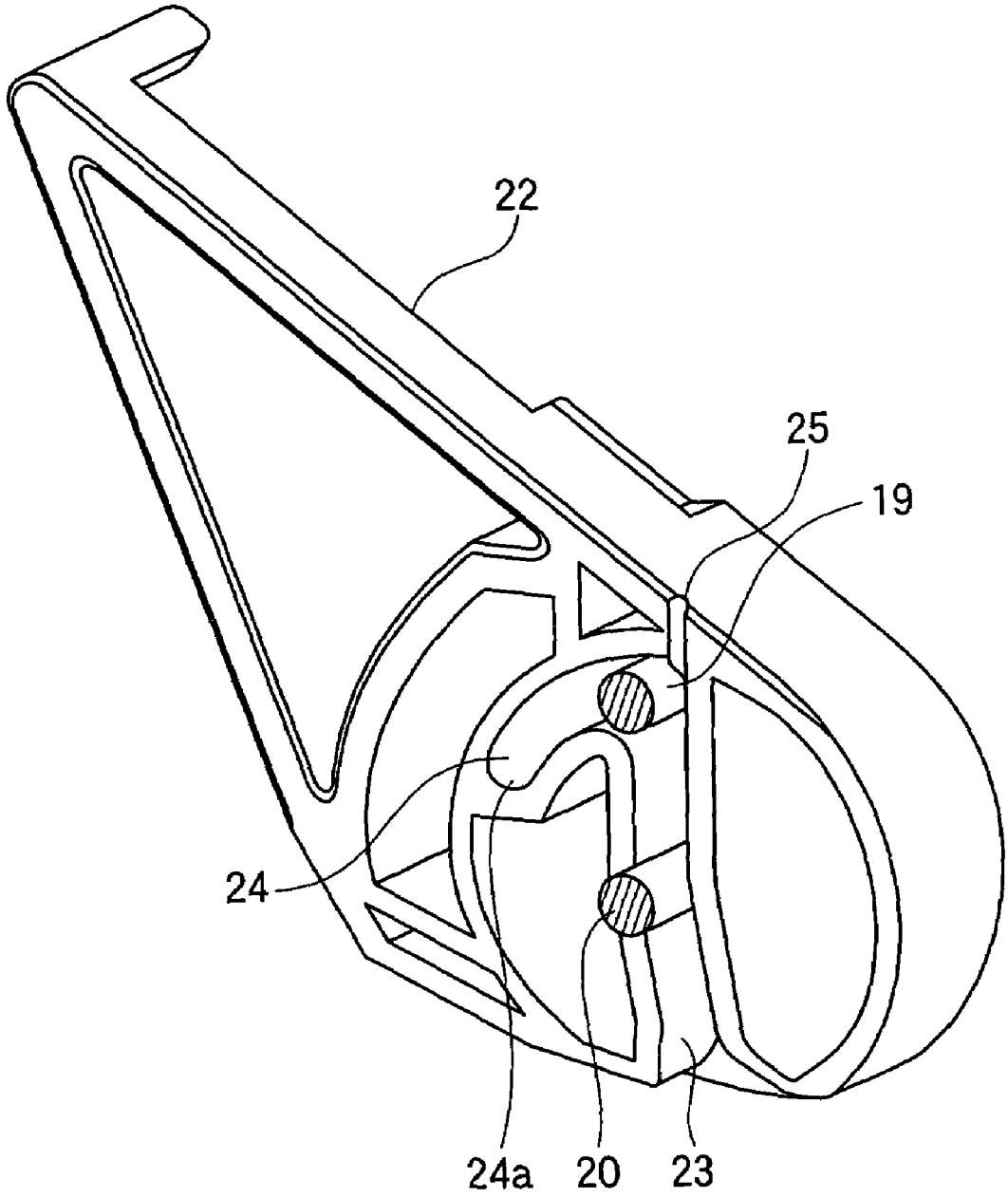
FIG. 1 is a perspective view of a pertinent portion of a first embodiment.
Figure 2:
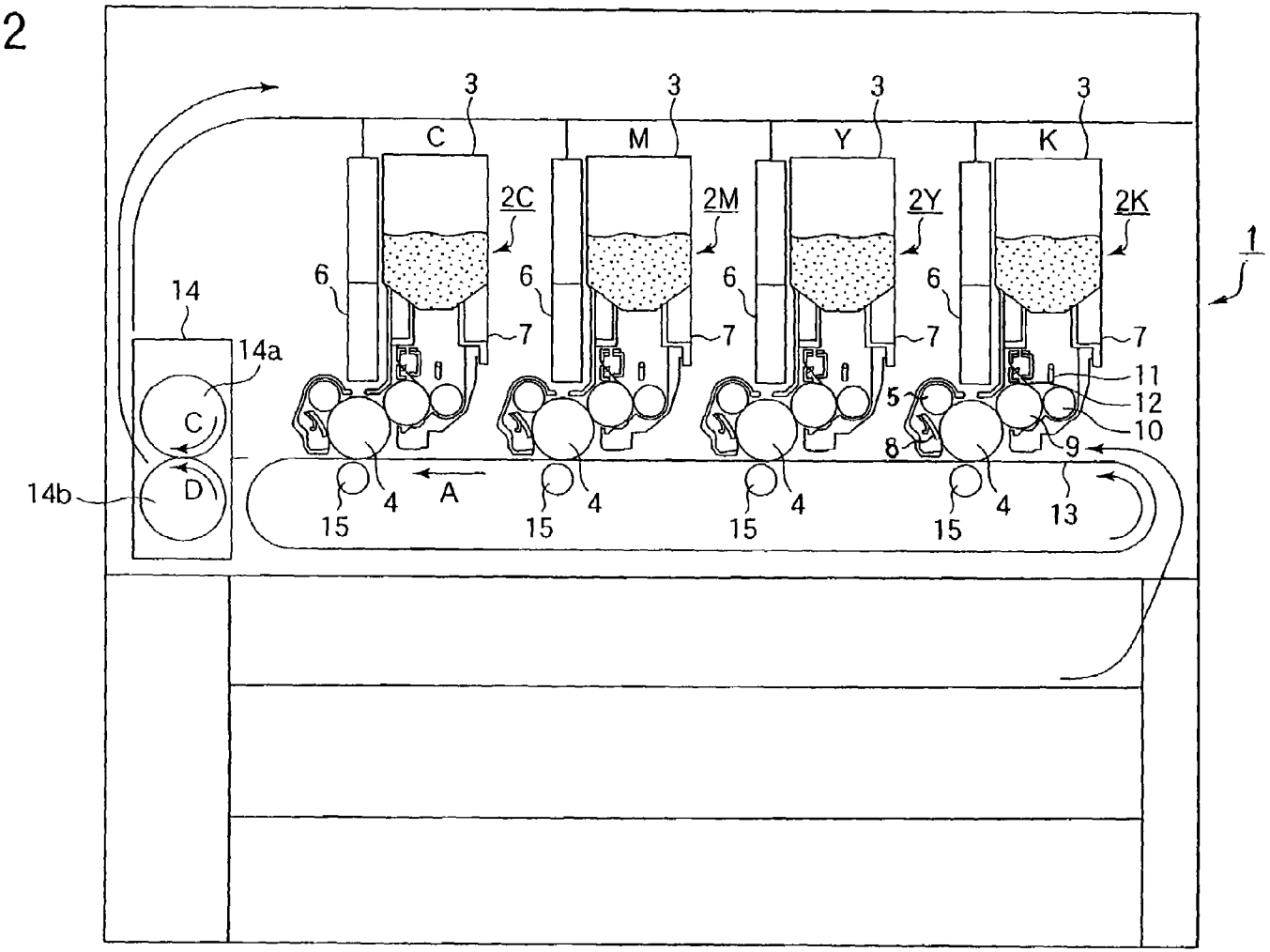
FIG. 2 is a general configuration of an electrophotographic printing apparatus to which the first embodiment is applied.
Figure 3:
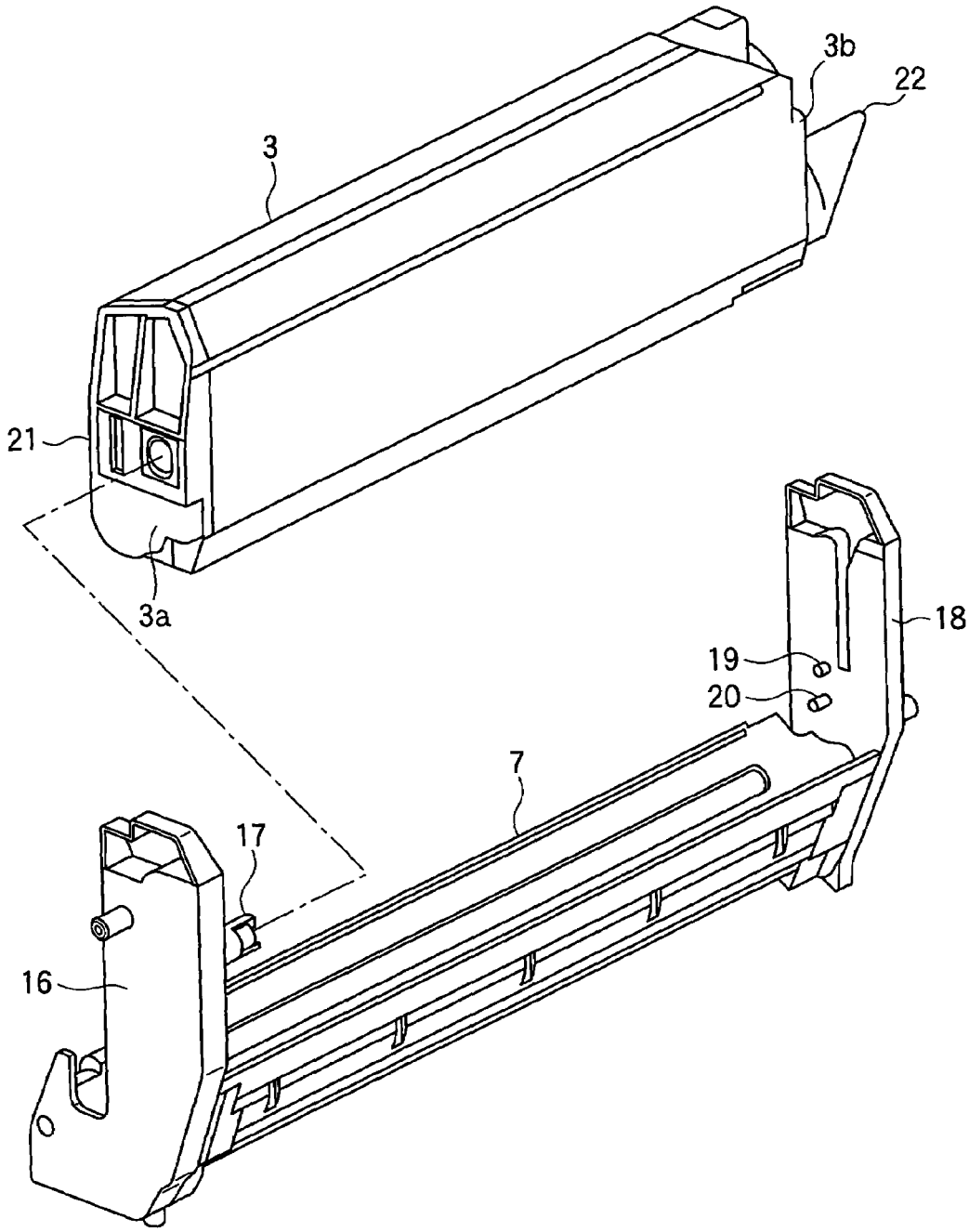
FIG. 3 is an exploded perspective view of a toner cartridge and a developing unit.

Embodiments of the present invention will be described with reference to the accompanying drawings. Like elements have been given like reference numerals throughout the drawings. FIG. 1 is a perspective view of a pertinent portion of a first embodiment. FIG. 2 is a general configuration of an electrophotographic printing apparatus to which the first embodiment is applied. FIG. 3 is an exploded perspective view of a toner cartridge and a developing unit.

The electrophotographic printing apparatus according to the invention will be described with reference to FIG. 2.

The electrophotographic printing apparatus in FIG. 2 is a tandem type color printer, and includes black, yellow, magenta, and cyan image forming sections 2K, 2Y, 2M, and 2C. Each of the image forming sections may be substantially identical; for simplicity only the image forming section 2K for black image will be described, it being understood that the other image forming sections 2Y, 2M, and 2C may work in a similar fashion.

The image forming section 2K includes primarily a photoconductive drum 4, a charging roller 5, an LED head 6, a developing unit 7, and a cleaning blade 8. The charging roller 5 charges the surface of the photoconductive drum 4 to a predetermined potential. The LED head 6 illuminates the charged surface of the photoconductive drum 4 to form an electrostatic latent image. The developing unit 7 supplies toner to the electrostatic latent image to develop the electrostatic latent image into a toner image. The cleaning blade 8 removes residual toner from the photoconductive drum 4. The LED head 6 is mounted to a cover, not shown, of the electrophotographic printer 1, so that when the cover is closed, the LED head 6 is immediately over the photoconductive drum 4.

A toner cartridge 3 is detachably attached to the developing unit 7, and supplies toner into the developing unit 7. The developing unit 7 includes primarily a developing roller 9 that supplies toner to the photoconductive drum 4, a toner-supplying roller 10 that supplies the toner to the developing roller 9, an agitator 11 that agitates the toner, and a developing blade 12 that forms a thin layer of toner on the developing roller 9.

A transfer belt 13 is disposed under the image-forming sections 2K, 2Y, 2M, and 2C, and runs in a direction shown by arrow A with print paper, not shown, placed thereon. Transfer rollers 15 are disposed with the transfer belt 13 sandwiched between the transfer rollers 15 and the photoconductive drums 4. The transfer rollers 15 causes the toner images of the respective colors to be transferred from the photoconductive drum 4 onto the print paper placed on the transfer belt 13.

A fixing unit 14 is disposed at a left end area of the image-forming apparatus 1 (downstream of the transfer belt 13 with respect to a direction in which the print paper is transported on the transfer belt 13). The fixing unit 14 includes a heat roller 14*a* and a pressure roller 14*b*. The heat roller 14*a* and pressure roller 14*b* are in pressure contact with each other to form a transfer point at a nip. The heat roll 14*a* and pressure roller 14 rotate in directions shown by arrows C and D, respectively, so that when the print paper passes through the transfer point, the toner image on the print paper is fused under heat and pressure into the print paper. Then, the print paper is discharged from an upper portion of the image-forming apparatus 1.

The developing unit 7 and toner cartridge 3 will be described with reference to FIG. 3. The developing unit 7 has two opposing side frames 16 and 18. A projection 17 is formed on the side frame 16 to project toward the side frame 18, and guide pins 19 and 20 are formed on the side frame 18 to project toward the side frame 16. The toner cartridge 3 has one longitudinal end wall 3*a* having an engagement hole 21 and another longitudinal end wall 3*b* to which an operating lever 22 is pivotally mounted.

The toner cartridge 3 is installed into the developing unit 7 as follows: A user inserts the projection 17 into the engagement hole 21 of the toner cartridge 3 and then slowly lowers the side wall 3*b* of the toner cartridge 3 until the guide pins 19 and 20 enter a guide groove 23 (FIG. 1) formed in the operating lever 22. This completes installment of the toner cartridge 3 into the developing unit 7.

FIG. 1 is a perspective view illustrating the positional relationship between the operating lever 22 and guide pins 19 and 20 when the toner cartridge 3 has been attached to the developing unit 7. Referring to FIG. 1, the operating lever 22 has a substantially straight guide groove 23 into which the guide pins 19 and 20 enter when the toner cartridge 3 is installed into the developing unit 7. The guide groove 23 communicates with an arc-shaped guide groove 24. When the operating lever 22 is pivoted, the guide pin 19 enters the guide groove 24, and is guided by the guide groove 24 until the guide pin 19 abuts an end 24*a* of the guide groove 24.

Figure 4:
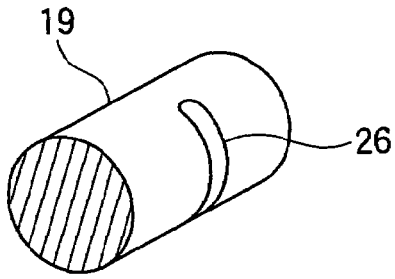
FIG. 4 is a perspective view of a slit-like guide formed in a guide pin.

FIG. 4 is a perspective view of a slit-like guide 26 formed in the guide pin 19. A pin groove 25 (FIG. 1) is formed in the operating lever 22 at a location where the guide groove 23 communicates with the guide groove 24. Referring back to FIG. 1, the pin groove 25 and slit-like groove 26 are formed such that when the toner cartridge 3 is installed into the developing unit 7, the pin groove 25 and slit-like groove 26 are in line with each other.

Figure 5:
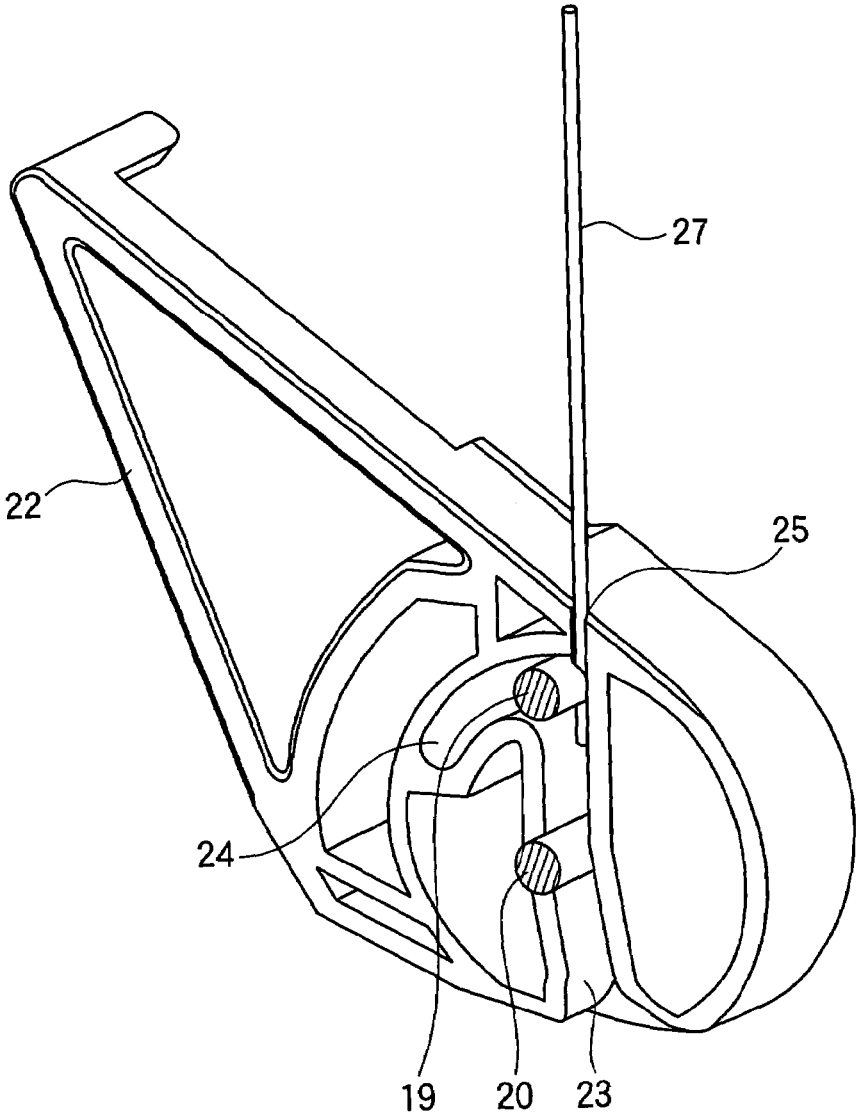
FIG. 5 is a perspective view of an operating lever and guide pins when a tool pin is mounted to the operating lever.

FIG. 5 is a perspective view of the operating lever 22 and guide pins 19 and 20 when the tool pin 27 is inserted into the slit-like groove 25 of the operating lever 22. Referring to FIG. 5, when the toner cartridge 3 has been installed into the developing unit 7, the tool pin 27 can be inserted into the pin groove 25 and slit-like groove 26 from above. The tool pin 27 extends through the slit-like groove 26 and further into the groove 23.

Figure 6:
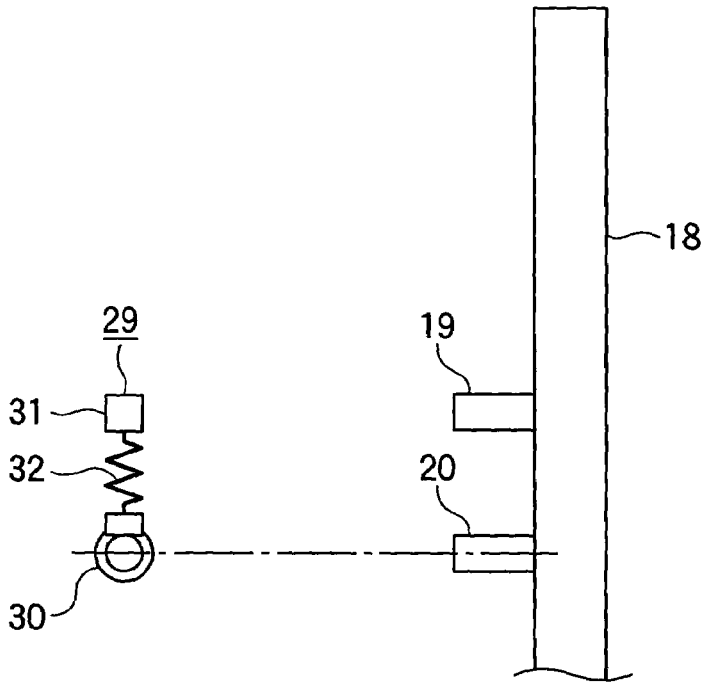
FIGS. 6 and 7 are side views illustrating a locking mechanism for the toner cartridge.
Figure 7:
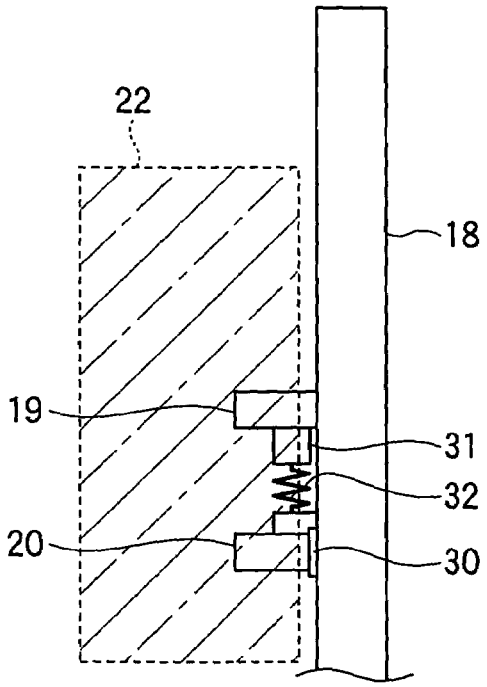

FIGS. 6 and 7 are side views illustrating a locking mechanism 29 for the toner cartridge 3. The locking mechanism 29 is assembled to the side frame 18. The locking mechanism 29 includes a ring piece 30, a rectangular piece 31 having a substantially the same width as the diameters of the guide pins 19 and 20, and a compression spring 32 mounted between the ring piece 30 and rectangular piece 31. The guide pin 20 extends through the ring piece 30. Referring to FIGS. 6 and 7, the locking mechanism 29 is mounted on the developing unit 7 side such that the spring 32 urges the rectangular piece 31 against the guide pin 19.

The locking mechanism 29 is assembled between the guide pin 19 and the guide pin 20. The ring piece 30 is fitted to the guide pin 20 while the rectangular piece 31 is in pressure engagement with the guide pin 19. At this moment, the spring 32 urges the rectangular piece 31 against the guide pin 19.

The width of the rectangular piece 31 and spring 32 is smaller than or the same as the diameter of the guide pins 19 and 20. Thus, when the toner cartridge 3 is installed into the developing unit 7, both the rectangular piece 31 and spring 32 can enter the guide groove 23. As shown in FIG. 7, it is to be noted that the ring piece 30 is away from the operating lever 22 when the toner cartridge 3 has been installed into the developing unit 7.

Figure 8:
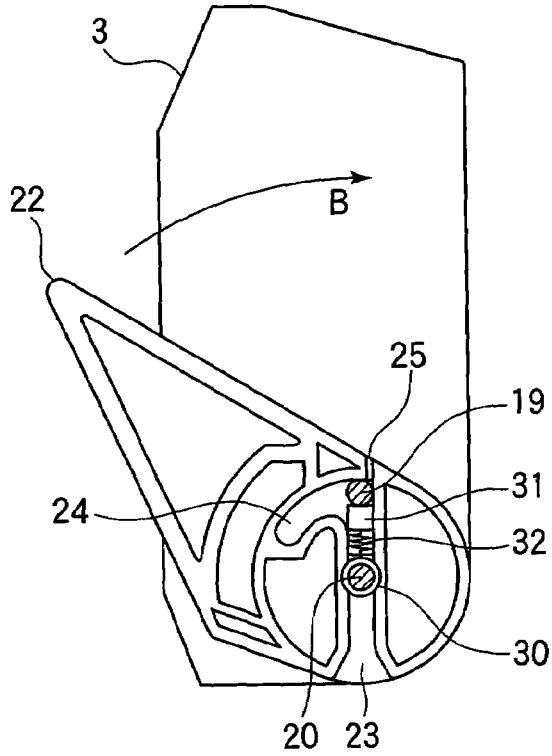
FIGS. 8-10 are side views illustrating the operation of the first embodiment.
Figure 9:
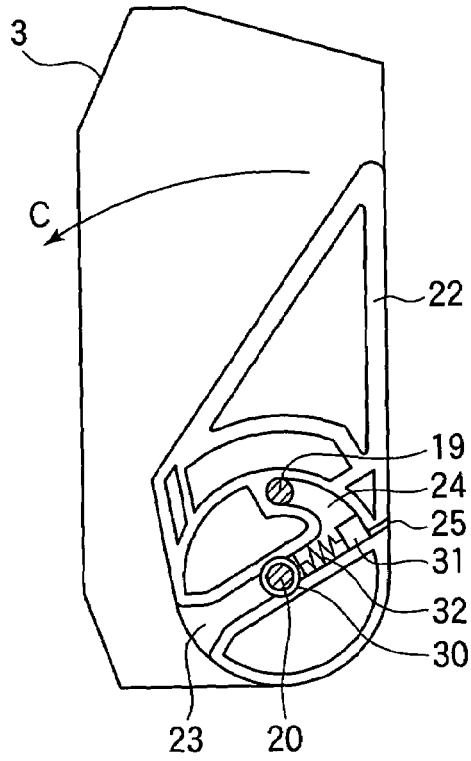
Figure 10:
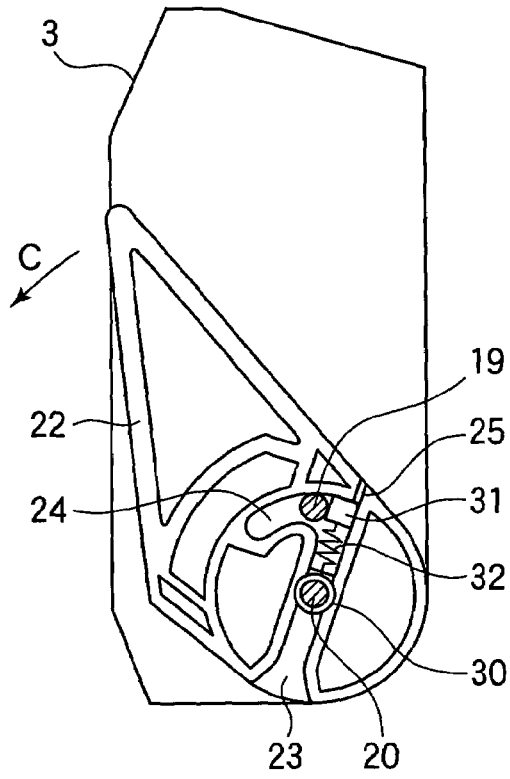

FIGS. 8-10 are side views illustrating the operation of the first embodiment. A description will be given of the operation in which the toner cartridge 3 is attached to and detached from the developing unit 7. Referring back to FIG. 3, when the toner cartridge 3 is installed into the developing unit 7, the one end 3*a* of the toner cartridge 3 is first lowered so that the projection 17 of the developing unit 7 enters the engagement hole 21 formed in the toner cartridge 3. Then, the other end 3*b* of the toner cartridge 3 is lowered so that the guide pins 19 and 20 enter the guide groove 23 formed in the operating lever 22, thereby attaching the toner cartridge 3 into the developing unit 7 as shown in FIG. 8.

Immediately after the toner cartridge 3 has been installed into the developing unit 7, the guide pin 20 is at a pivotal axis of the operating lever 22 and the guide pin 19 is at the location where the guide groove 23 communicates with the guide groove 24. A user operates the operating lever 22 to pivot in a direction shown by arrow B to supply the toner from the toner cartridge 3 into the developing unit 7.

The operating lever 22 pivots about the guide pin 20 until the guide pin 19 abuts the end 24*a* of the guide groove 24. As a result, the shutter of the toner cartridge 3, not shown, is opened allowing the toner to fall into the developing unit 7. The pivotal motion of the operating lever 22 causes the side wall of the guide groove 23 to push the locking mechanism 29, so that the locking mechanism 29 rotates together with the operating lever 22. Thus, as shown in FIG. 9, the rectangular piece 31 leaves the guide pin 19 and the urging force of the spring 32 causes the rectangular piece 31 to abut the side wall of the guide groove 24.

A description will be given of the operation in which the toner cartridge 3 is detached from the developing unit 7. The operating lever 22 is pivoted in a direction shown by arrow C from the position in FIG. 9 to the position in FIG. 10. In other words, the rectangular piece 31 abuts the guide pin 19 and the operating lever 22 cannot pivot any further. At this situation, the toner cartridge 3 cannot be detached from the developing unit 7.

If the user desires to detach the toner cartridge 3 from the developing unit 7, the user inserts the tool pin 27 into the pin groove 25 from above. The tip of the tool pin 27 abuts the rectangular piece 31. If the user pushes the tool pin 27 further into the pin groove 25, the tool pin 27 pushes down the rectangular piece 31 against the urging force of the spring 32. This allows the operating lever 22 to pivot further in the B direction.

Figure 11:
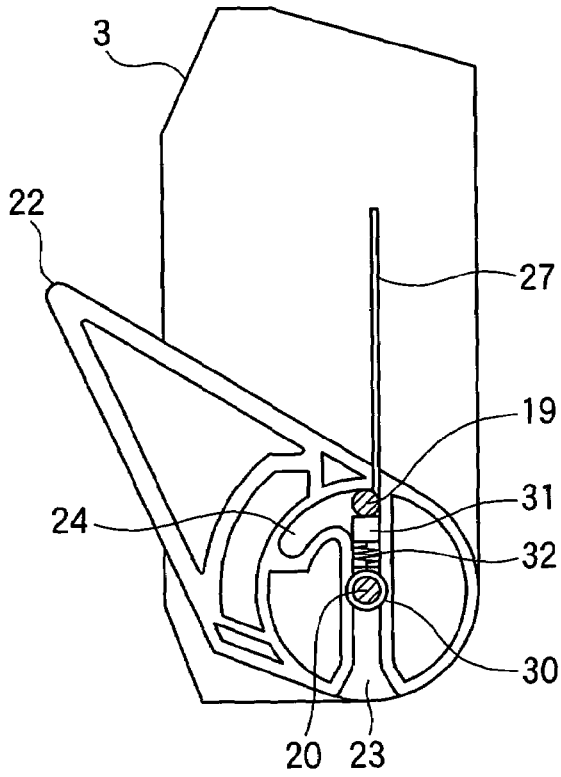
FIG. 11 illustrates the positional relationship between the operating lever and the locking mechanism when the tool pin is inserted.

FIG. 11 illustrates the positional relationship between the operating lever 22 and the locking mechanism 29 when the tool pin 27 is inserted.

When the operating lever 22 is caused to pivot with the rectangular piece 31 pushed down, the tool pin 27 pivots together with the operating lever 22 to enter the slit-like groove 26 in the guide pin 19 as shown in FIG. 11. At this moment, the locking mechanism 29 is held between the guide pin 19 and the guide pin 20 so that the rectangular piece 31, spring 32, and guide pins 19 and 20 are in the guide groove 23. Thus, the toner cartridge 3 can be taken out of the developing unit 7. Providing the slit-like groove 26 in the guide pin 19 that receives the tool pin 27 allows the operating lever 22 to pivot to a position where the operating lever 22 was when the toner cartridge has been installed into the developing unit 7.

As described above, unless the exclusive tool pin 27 is used, the operating lever 22 cannot be pivoted to a position where the toner cartridge 3 can be detached from the developing unit 7. When the toner cartridge 3 has been normally attached to the developing unit 7, the groove 23 formed in the operating lever 22 cannot be seen. Therefore, a user who does not know how the locking mechanism 29 works cannot detach the toner cartridge 3 from the developing unit 7. Thus the configuration according to the first embodiment prevents spill of toner that would otherwise be caused due to replacement of toner cartridge performed by an unskilled person. The first embodiment also reduces chance of the toner cartridge 3 of being replaced by a similar but unacceptable toner cartridge.

The first embodiment allows the manufacturer to provide an apparatus in two different configurations depending on whether the locking mechanism 29 is used: an apparatus where a toner cartridge can be detachably attached to a developing unit, and an apparatus where a toner cartridge is permanently attached. The aforementioned structure allows product modifications so that they may be configured according to product grades and customers. Although the spring 32 has been described with respect to a compression spring, another type of spring such as a flat may be used.

Second Embodiment

Figure 12A:
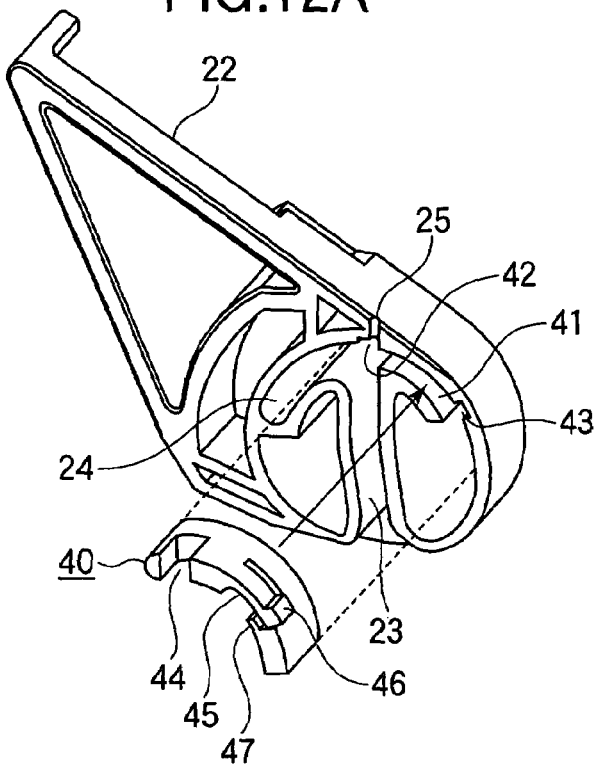
FIG. 12A is a perspective view of a locking piece according to a second embodiment.
Figure 12B:
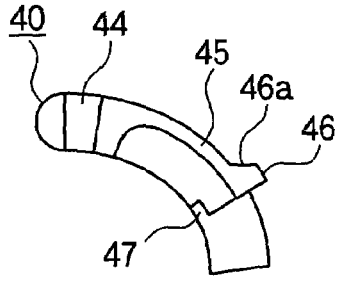
FIG. 12B is an enlarged view of the locking piece of FIG. 12A.
Figure 13:
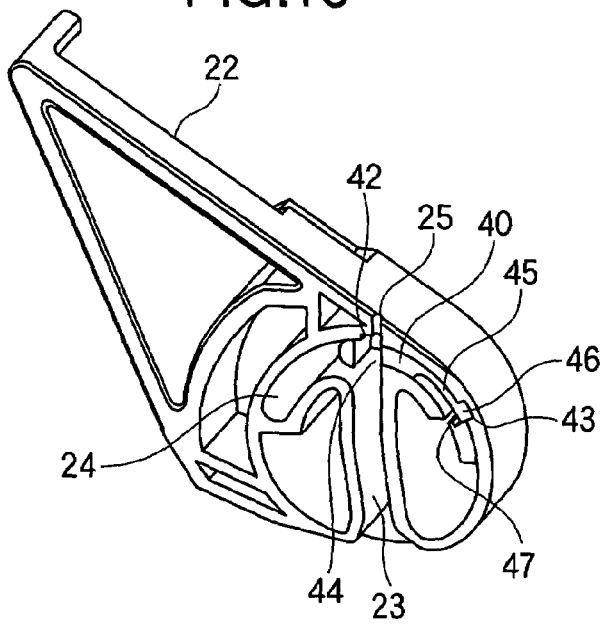
FIG. 13 is a perspective view of the locking piece when a locking mechanism is attached to an operating lever.
Figure 14:
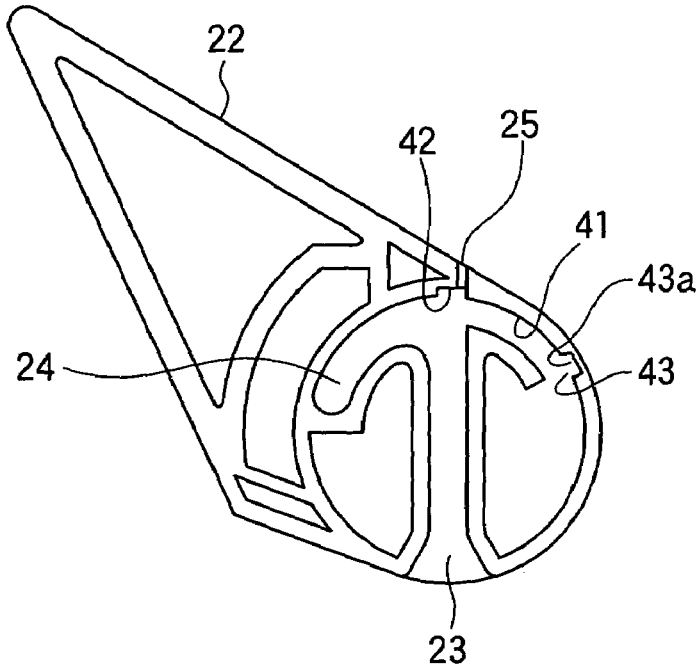
FIG. 14 is a side view of the operating lever.
Figure 15:
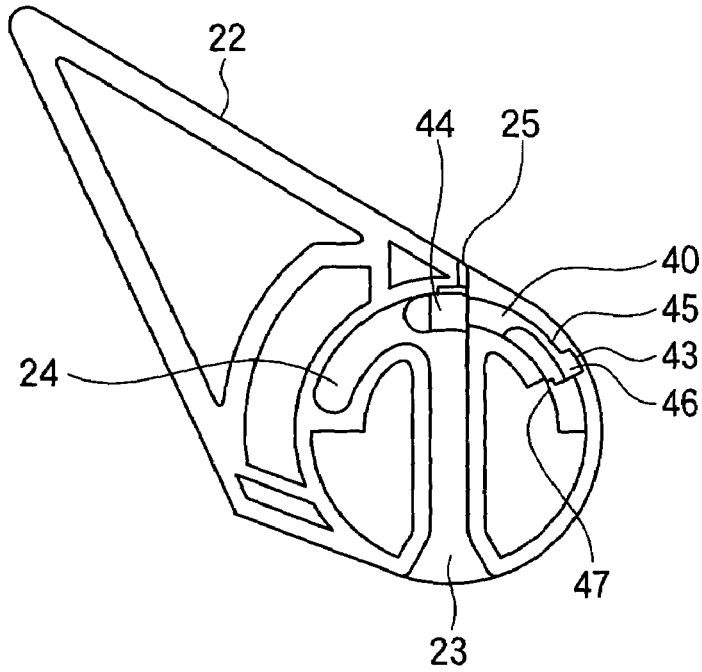
FIG. 15 is a side view of the locking piece when the locking piece is attached to the operating lever.

FIG. 12A is a perspective view of a locking piece 40 according to a second embodiment. FIG. 12B is an enlarged view of the locking piece 40. FIG. 13 is a perspective view of the locking piece 40 when the locking piece 40 is attached to an operating lever 22. FIG. 14 is a side view of the operating lever 22. FIG. 15 is a side view of the locking piece 40 and the operating lever 22 when the locking piece 40 is attached to the operating lever 22.

Referring to FIGS. 12A-15, the operating lever 22 mounted to a toner cartridge 3, not shown, is formed with a guide groove 24 and a guide groove 41. A locking piece 40 is slidable in the guide groove 24 and guide groove 41. The guide groove 41 and guide 24 extend in substantially the same circumferential direction. The locking piece 40 has a smaller width than the guide groove 24 and guide groove 41 so that the locking piece 40 can slide in the guide groove 24 and guide groove 41. The guide groove 41 has a recess 42 formed in its side wall at one circumferential end of the guide groove 41 and another recess 43 formed in its side wall at another circumferential end of the guide groove 41. The recess 42 communicates with a pin groove 25.

The side wall of the recess 43 may have a beveled or inclined surface 43*a*, so that when the operating lever 22 is pivoted in a direction shown by arrow D (FIG. 16), the projection 46 can easily climb the beveled surface 43*a* of the recess 43 to move out of the recess 43. This helps the operating lever 22 pivot smoothly.

Referring to FIG. 12A, the locking piece 40 is generally in the shape of an arc. The locking piece 40 has substantially the same radius of curvature as the guide groove 41 and 24, and a width such that the locking piece 40 can be loosely fitted into the guide grooves 24 and 41. The locking piece 40 is formed with a cutout 44 into which a guide pin 19 of a developing unit 7 can fit, a flat spring 45 that can be resiliently depressed toward the center of the curvature, a projection 46 that is formed on a free end portion of the flat spring 45 and has a beveled surface 46*a*, and a stopper 47 that limits the flexing of the projection 46 toward the center of curvature of the locking piece 40.

When the locking piece 40 has been assembled in the guide groove 41 formed in the operating lever 22 as shown in FIGS. 13 and 15, the groove 44 formed in the locking piece 40 communicates with the guide groove 23, so that the guide pin 19 of the developing unit 7 can enter from the guide groove 23 into the groove 44. At this moment, the projection 46 is fitted into the recess 43.

The operation of the second embodiment will be described. A description will be given of the operation in which the toner cartridge 3 is attached to and detached from the developing unit 7, particularly the operation of an operating lever 22 provided on the toner cartridge 3.

Figure 16:
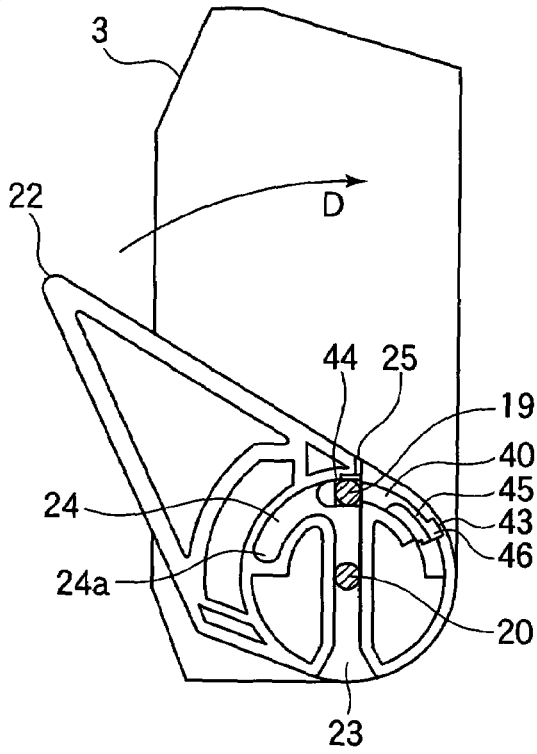
FIG. 16 illustrates the operating lever shortly after a toner cartridge has been installed into a developing unit.

FIG. 16 illustrates the operating lever 22 shortly after the toner cartridge 3 has been installed into the developing unit 7. Referring to FIG. 16, the guide pin 19 is at one end of the guide groove 23, and is received in the groove 44 of the locking piece 40. The guide pin 20 of the developing unit 7 is at the center of pivotal motion of the operating lever 22. From this position, the operating lever 22 is pivoted in a direction shown by arrow D to supply the toner from the toner cartridge 3 into the developing unit 7.

When the operating lever 22 is pivoted about the guide pin 20, the guide pin 19 prevents the locking piece 40 from moving, so that the flat spring 45 of the locking piece 40 flexes inwardly and therefore the projection 46 moves out of the recess 43. When the operating lever 22 is pivoted until the end of the locking piece 40 abuts the end 24*a* of the guide groove 24, the shutter of the toner cartridge 3, not shown, is completely opened and the toner falls from the toner cartridge 3 into the developing unit 7.

Figure 17:
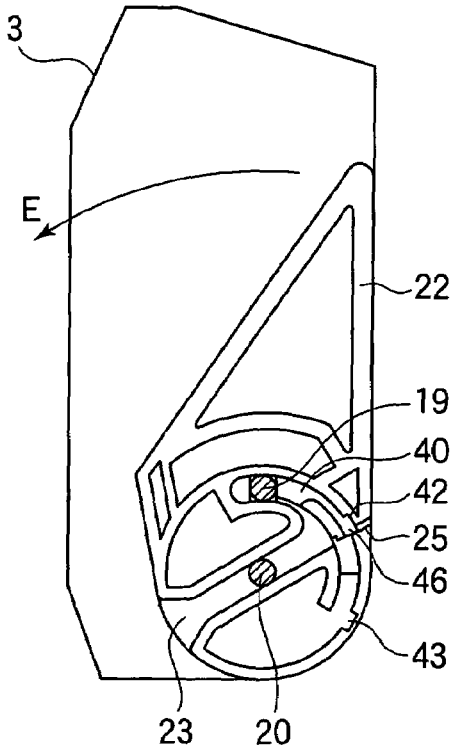
FIG. 17 illustrates the operating lever when it is pivoted in the A direction in FIG. 16.

FIG. 17 illustrates the operating lever 22 when it is pivoted in the D direction in FIG. 16. Referring to FIG. 17, at this moment, the urging force of the flat spring 45 causes the projection 46 to fit into the recess 42. Because the projection 46 fits into the recess 42, when the user attempts to cause the operating lever 22 to pivot in a direction shown by arrow E, the projection 46 abuts the side wall of the recess 42 to prevent the operating lever 22 from pivoting. With this situation, the toner cartridge 3 cannot be detached from the developing unit 7.

Figure 18:
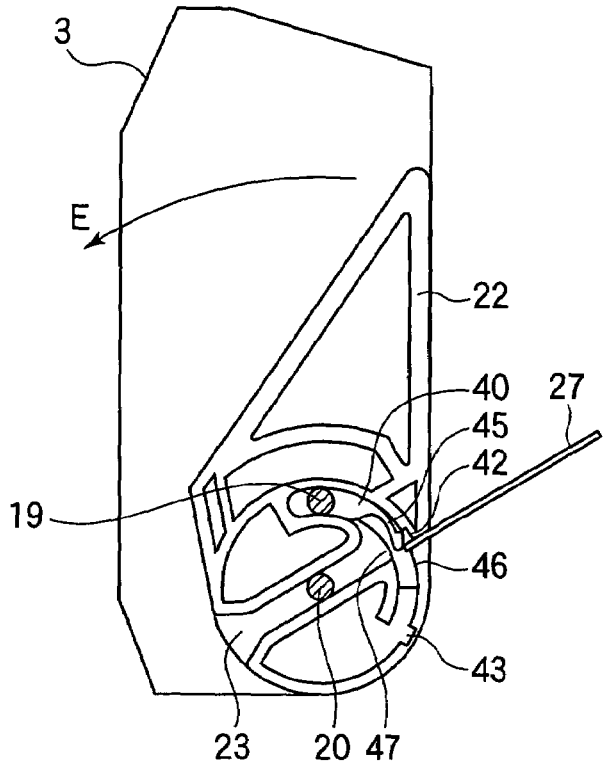
FIG. 18 illustrates the operating lever when the tool pin is inserted into a pin groove.

FIG. 18 illustrates the operating lever 22 when a tool pin 27 is inserted into a pin groove 25. When the toner cartridge 3 is detached from the developing unit 7, a user inserts a tool pin 27 into a pin groove 25 as shown in FIG. 18. The tool pin 27 abuts the projection 46. The user pushes the tool pin 27 further into the pin groove 25 so that the tool pin 27 depresses the projection 46 against the urging force of the flat spring 45 until the projection 46 moves out of the recess 42. Once the projection 46 moves out of the recess 42, the operating lever 22 is allowed to pivot in the E direction. If the tool pin 27 is pushed excessively into the pin groove 25, the tip of the projection 46 abuts the stopper 47. The abutting engagement of the projection 46 with the stopper 47 prevents the flat spring 45 from being broken and the operating lever 22 from becoming unable to pivot.

Figure 19:
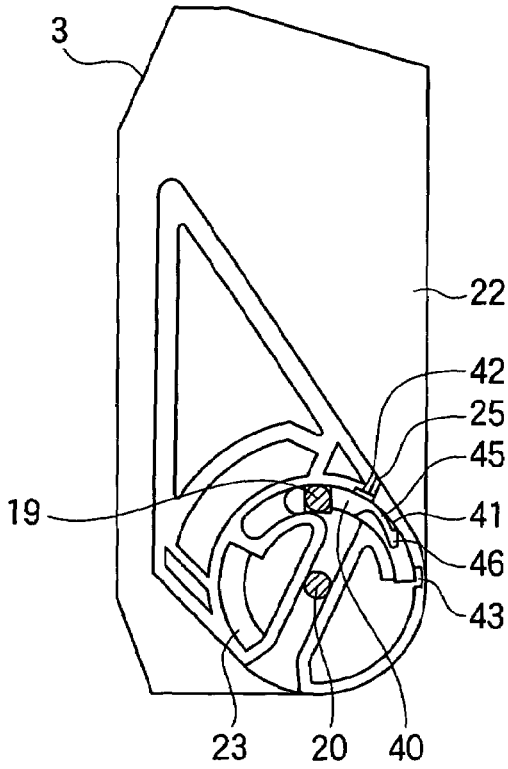
FIG. 19 illustrates the positional relationship between the operating lever and the locking piece when the operating lever pivots in the E direction.

FIG. 19 illustrates the positional relationship between the operating lever 22 and the locking piece 40 when the operating lever 22 pivots in the E direction. When the operating lever 22 is pivoted in the E direction, the projection 46 slides on the side wall of the guide groove 41 as shown in FIG. 19. When the operating lever 22 reaches the position in FIG. 16, the projection 46 drops in the recess 43 due to the urging force of the flat spring 45. In FIG. 16, both the guide pin 19 and the guide pin 20 are within the guide groove 23 and therefore the toner cartridge 3 can be detached from the developing unit 7. The tool pin 27 may be pulled out once the operating lever 22 starts to pivot.

According to the second embodiment, unless the exclusive tool pin 27 is used, the operating lever 22 cannot be pivoted to a position where the toner cartridge 3 can be detached from the developing unit 7. When the toner cartridge 3 has been normally attached to the developing unit 7, the groove 23 formed in the operating lever 22 cannot be visible to the user. Therefore, a user who does not know how the mechanism of locking works cannot detach the toner cartridge 3 from the developing unit 7. Thus the configuration according to the second embodiment prevents spill of toner that would otherwise be caused due to replacement of toner cartridge performed by an unskilled person. The first embodiment also reduces chance of the toner cartridge of being replaced by a similar but unacceptable toner cartridge.

The locking piece 40 is a single piece part. Adding such a single piece part to the operating lever 22 of the toner cartridge 3 offers the aforementioned locking operation. This reduces the manufacturing cost. The operating lever 22 can be locked at a position where the shutter is completely opened without allowing some play in rotation, and ensures that the user can feel that the operating lever 22 has been in a locked state.

Third Embodiment

Figure 20:
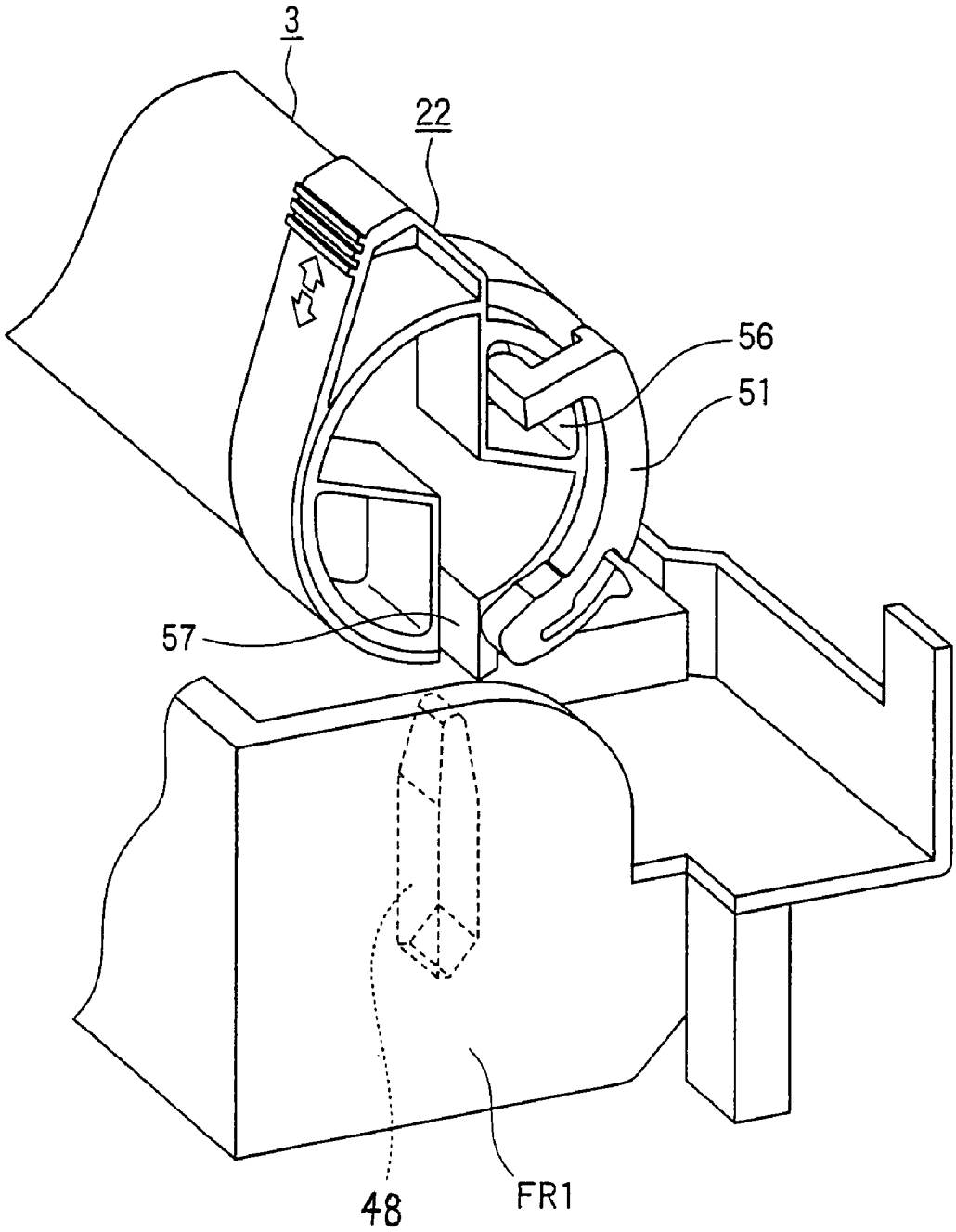
FIG. 20 is a fragmentary perspective view illustrating a locking piece according to a third embodiment.

FIG. 20 is a fragmentary perspective view illustrating a locking piece 51 according to a third embodiment. Referring to FIG. 20, an operating lever 22 is provided at one end of the toner cartridge 3 and the locking pin 51 is mounted to the operating lever 22.

Figure 21A:
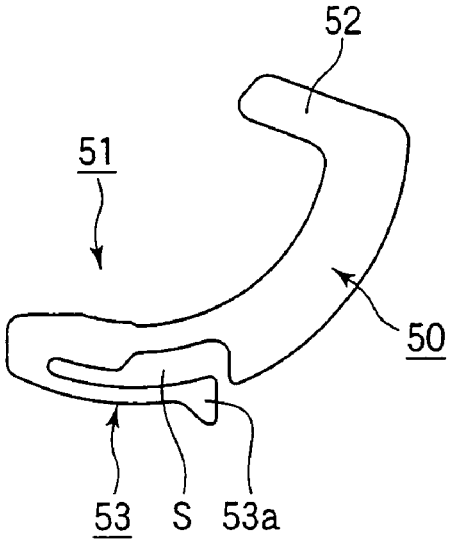
FIGS. 21A and 21B are front views of the locking piece.
Figure 21B:
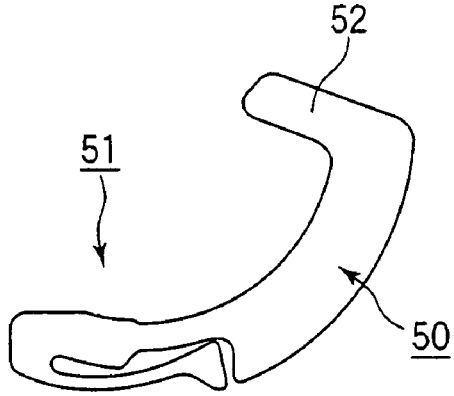
Figure 22:
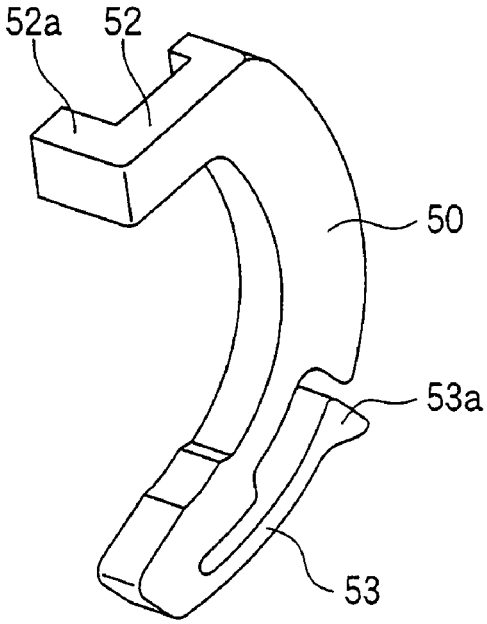
FIG. 22 is a perspective view of the locking piece.

FIG. 21A is a front view of the locking piece 51 and FIG. 22 is a perspective view of the locking piece 51. Referring to FIG. 21A, the locking piece 51 generally extends along a circumference concentric with the center of rotation of the operating lever 22. The locking piece 51 has a projection 52 that is formed at one end of an arcuate body 50 and extends radially inwardly. The locking piece 51 has a free end portion 52*a* (FIG. 22) that extends in a direction substantially parallel to an axis of rotation of the operating lever 22. The locking piece 51 has an arcuate spring 53 that folds back outwardly from one end of the locking piece 51 to create an arcuate gap S between the arcuate body 50 and the arcuate spring 53. The arcuate spring 53 has a free end portion with an engagement portion 53*a*. FIG. 21B is another front view when the arcuate spring 53 flexes. When the arcuate spring 53 flexes inwardly as shown in FIG. 21B, the free end portion 53*a* enters the gap S in such a way that the tip of the free end portion 53*a* is substantially on the circumference on which the arcuate outer surface of the body 50 lies.

Figure 23:
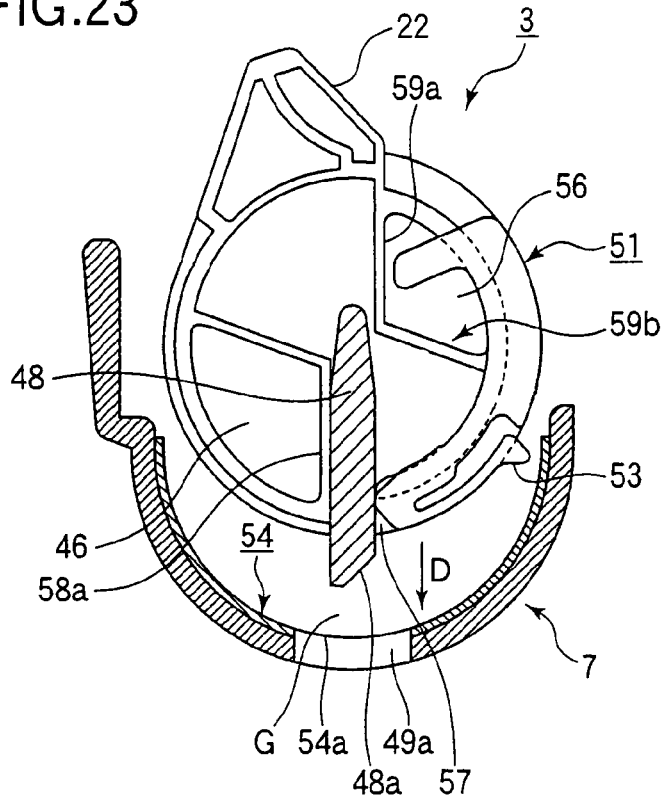
FIG. 23 illustrates the positional relationship among a projection, an operating lever, and the locking piece when a toner cartridge is being lowered into a developing unit.

FIG. 23 illustrates the positional relationship among a projection 48, operating lever 22, and locking piece 51 when the toner cartridge 3 is being lowered into a developing unit 7. An opening 49*a* is formed in a bottom wall of the developing unit 7 and a cutout 54*a* is formed in a sealing member 54 mounted to the toner cartridge 3 for sealing the toner. When the toner cartridge 3 is installed into the developing unit 7, the locking piece 51 is positioned close to the operating lever 22 and then the free end portion 52*a* is inserted into a recess 56 formed in the operating lever 22. Then, the free end portion 52*a* is mounted to the operating lever 22. At this moment, another end of the locking piece 51 is positioned adjacent to a cutout 57. The toner cartridge 3 is then lowered in a direction shown by arrow D, so that a projection 48 enters the cut out 57. The projection 48 advances into the operating lever 22, being guided by a wall 58*a*. As the toner cartridge 3 is lowered further, the locking piece 51 is also held in position by frame FR1. The toner cartridge 3 is lowered until the toner cartridge 3 abuts the bottom of the developing unit 7.

Figure 24:
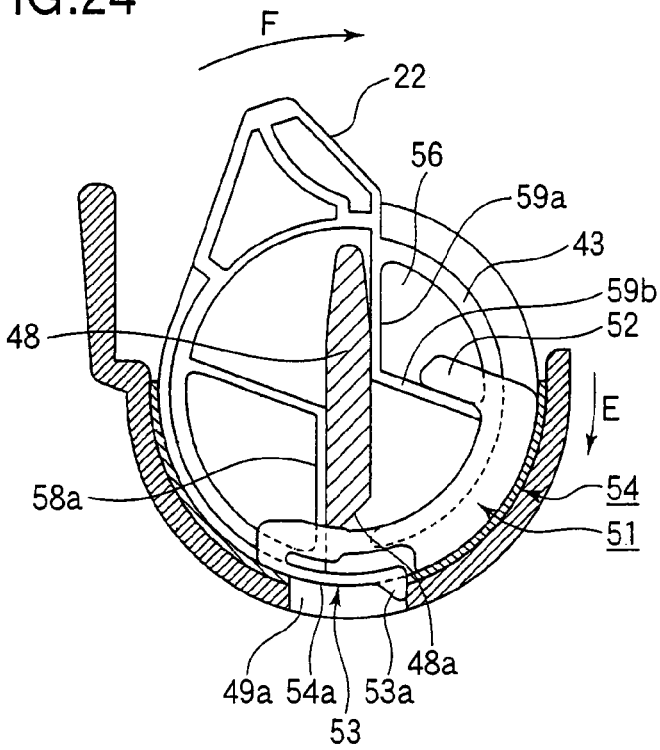
FIG. 24 illustrates the positional relationship among the projection, operating lever, and locking piece when the toner cartridge has been completely attached to the developing unit.

FIG. 24 illustrates the positional relationship among the projection 48, operating lever 22, and locking piece 51 when the toner cartridge 3 has been completely attached to the developing unit 7. After lowering the toner cartridge into the developing unit 7, a user uses a tool, not shown, to cause the locking piece 51 to displace in a direction shown by arrow E until the projection 52 abuts the wall 59*b*. Because the projection 48 has a beveled surface 48*a*, the locking piece 51 is smoothly guided under the projection 48. At this moment, the spring 53 of the locking piece 51 is in a gap G (FIG. 23) so that the engagement portion 53*a* drops in the opening 49*a* and the cutout 54*a*.

Figure 25:
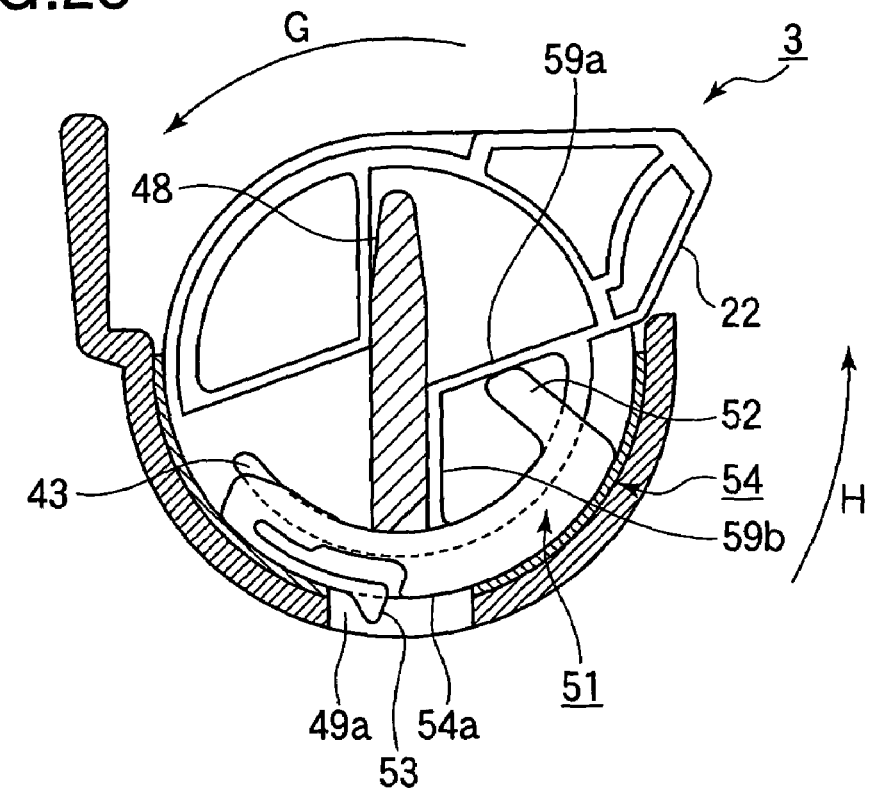
FIG. 25 illustrates the positional relationship among the projection, operating lever, and locking piece when the operating lever is pivoted in a direction shown by arrow F in FIG. 24.

FIG. 25 illustrates the positional relationship among the projection 48, operating lever 22, and locking piece 51 when the operating lever 22 is pivoted in a direction shown by arrow F in FIG. 24. When the operating lever 22 takes the position in FIG. 24, the user operates the operating lever 22 to pivot through a predetermined angle so that a shutter, not shown, is opened to supply toner from the toner cartridge 3 to the developing unit 7. Because the wall 59*b* is in contact with the locking piece 51, when the operating lever 22 is pivoted in the F direction, the locking piece 51 displaces somewhat in the E direction but the toner cartridge 3 remains in engagement with the projection 48.

Prior to the shipment of the apparatus, the operating lever 22 may be pivoted to a position where the toner is discharged from the toner cartridge 3 to the developing unit 7. This frees the user from rotating the operating lever 22 prior to the initial use of the apparatus. However, special care should be taken so that a toner chamber of the toner cartridge 3 is sufficiently sealed against the environment so that the toner will not leak due to vibration and shock during transportation.

For example, the use may attempt to detach the toner cartridge 3 from the developing unit 7 after toner exhaustion. The user operates the operating lever 22 in a direction shown by arrow G. The wall 59*b* pushes the projection 52 so that the locking piece 51 displaces in a direction shown by arrow H. When the locking piece 51 displaces in the H direction, the engagement portion 53*a* abuts the perimeters of the openings 49*a* and the cutout 54*a*, preventing the locking piece 51 from moving any further in the H direction. At this moment, the projection 48 remains in engagement with the locking piece 51 and the wall 59*a* is in engagement with the projection 52 of the locking piece 51, preventing the toner cartridge 3 from being detached from the developing unit 7.

The locking piece 51 is a single component. Adding such a single component to the operating lever 22 of the toner cartridge 3 offers the aforementioned locking operation. This provides a unitary construction of a process cartridge, i.e., an integral type process cartridge where the toner cartridge cannot be detached from the process cartridge and therefore a user is prevented from replacing with a new, unused toner cartridge upon exhaustion of toner. A construction without the locking piece 51 assembled to the toner cartridge provides a non-integral type process cartridge where the toner cartridge can be detached from the process cartridge and the user is allowed to replace with a new, unused toner cartridge upon exhaustion of toner.

The locking piece 51 may of course be disassembled from the toner cartridge 3 by using a special tool at a factory, thereby detaching the toner cartridge 3 from the developing unit 7 without causing damage to any parts of the toner cartridge and developing unit.

Fourth Embodiment

If a user knows how to disassemble a toner cartridge from a developing unit, he may attempt to replace an exhausted toner cartridge with a new, unused one, so that the apparatus may be used until major parts of the apparatus such as photoconductive drum and rollers reach their lifetime. When such apparatus are recovered in the factory, the apparatus that have reached its lifetime may be recycled inadvertently.

A fourth embodiment provides a configuration where it can be determined whether the recovered apparatus is an integral type process cartridge or a non-integral type process cartridge.

Figure 26:
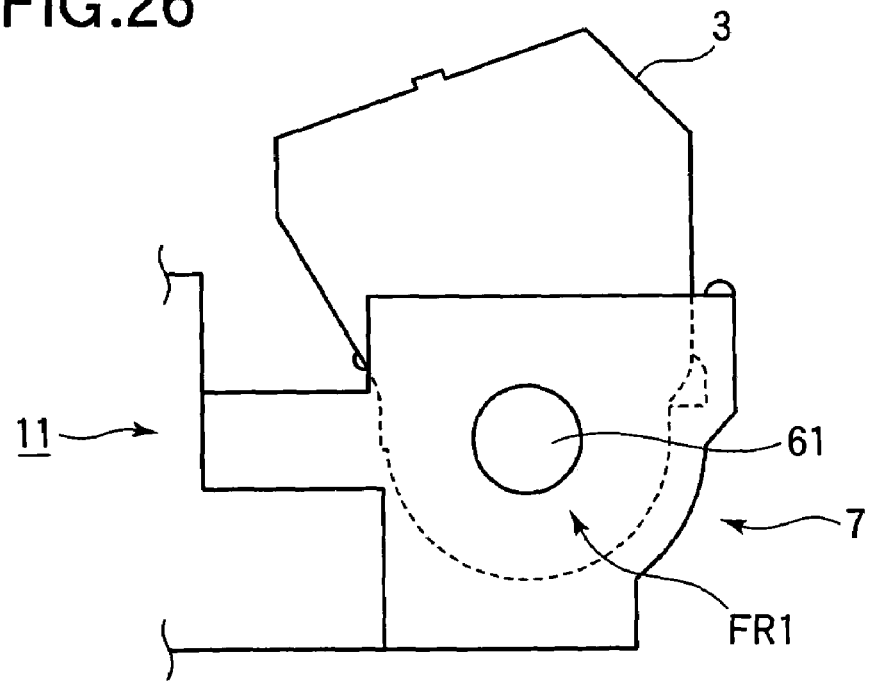
FIG. 26 is a schematic view of a fourth embodiment illustrating a toner cartridge and a developing unit when the toner cartridge has been attached to the developing unit.

FIG. 26 is a schematic view of the fourth embodiment illustrating a toner cartridge 3 and a developing unit 7 when the toner cartridge 3 has been attached to the developing unit 7.

Referring to FIG. 26, the developing unit 7 is attached to a developing unit 7 of a process cartridge 11. The toner cartridge 3 is attached to the developing unit 24.

Figure 27:
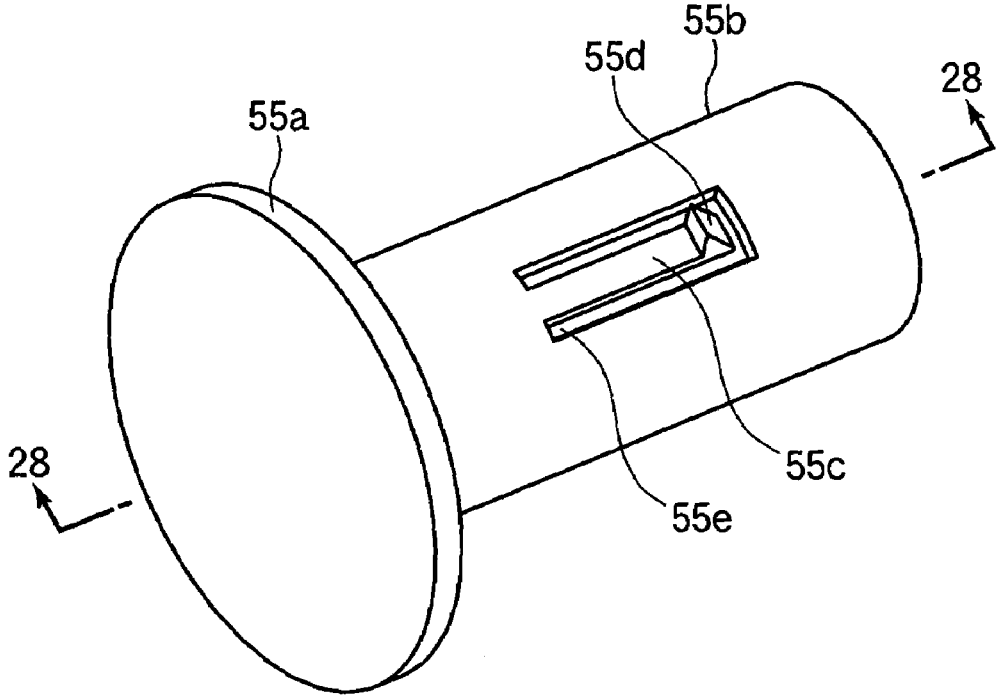
FIG. 27 is a perspective view of a pin.
Figure 28:
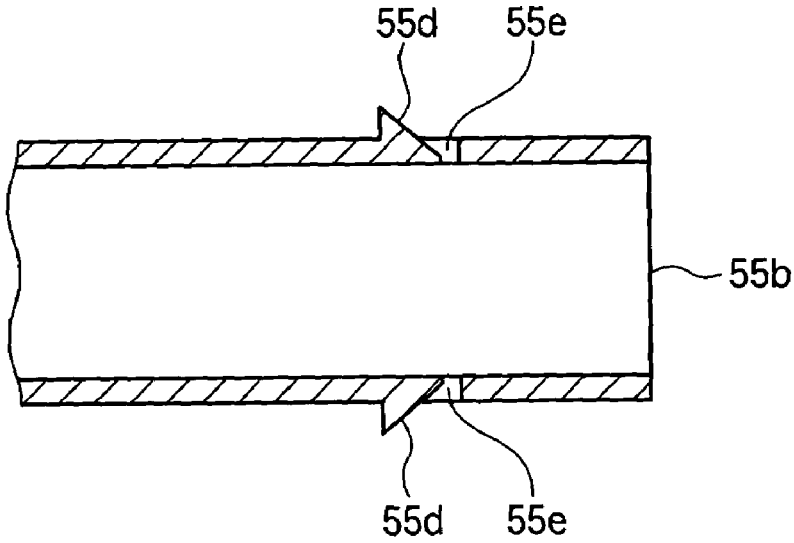
FIG. 28 is a fragmentary cross sectional view of the pin taken along a line 28-28 of FIG. 27.

FIG. 27 is a perspective view of a pin 55. FIG. 28 is a fragmentary cross sectional view of the pin 55 taken along a line 28-28 of FIG. 27. Referring to FIGS. 27 and 28, the pin 55 is made of a resiliently deformable material such as resin. The pin 55 has a hollow cylinder 55*b* closed at its one longitudinal end by a flange 55*a*. The hollow cylinder 55*b* is formed with U-shaped slit-like openings 55*e* therein that define a resilient tongue 55*c* having a free end with a projection 55*d*. The U-shaped slit-like openings 55*e* are formed in the hollow cylinder 55*b* at diametrically opposing positions (only one of the slit-like openings is shown in FIG. 27). The projection 55*d* projects outwardly from the hollow cylinder 55*b*.

Figure 29:
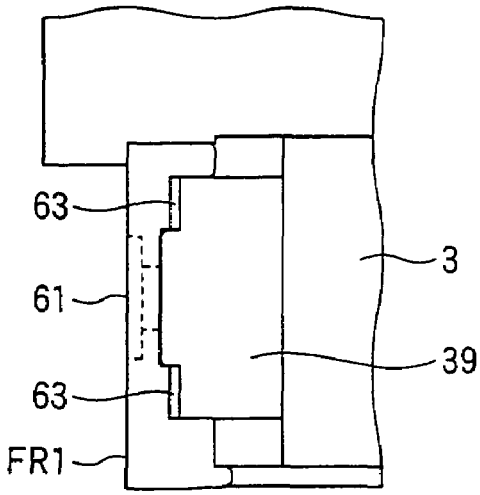
FIG. 29 is a fragmentary top view of the toner cartridge attached to a frame of the developing unit.

FIG. 29 is a fragmentary top view of the toner cartridge 3 attached to a frame FR1 of the developing unit 7. The frame FR1 is formed with a hole 61 through which the pin 55 is inserted into a cap 62 (FIG. 30) attached to the toner cartridge 3. Projections 63 are formed on an inner surface of the frame FR1.

Referring to FIG. 29, when the toner cartridge 3 is attached into the developing unit 7, one longitudinal end wall of the toner cartridge 3 is first fitted to the frame FR1 under the projections 63. Then, another longitudinal end of the toner cartridge 3 is lowered into the developing unit 7 so that a projection 48 of the developing unit 7 enters the cutout 41 (FIG. 20) in an operating lever 22. The operating lever 22 is pivoted in the F direction (FIG. 24) until the rib 43 engages the projection 48 so that the toner cartridge 3 is firmly coupled to the developing unit.

Figure 30:
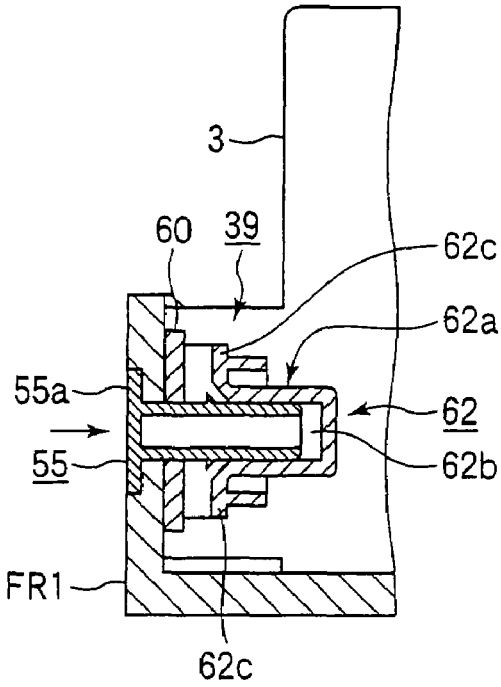
FIGS. 30-32 are cross-sectional views when the toner cartridge is detached from the developing unit.
Figure 31:
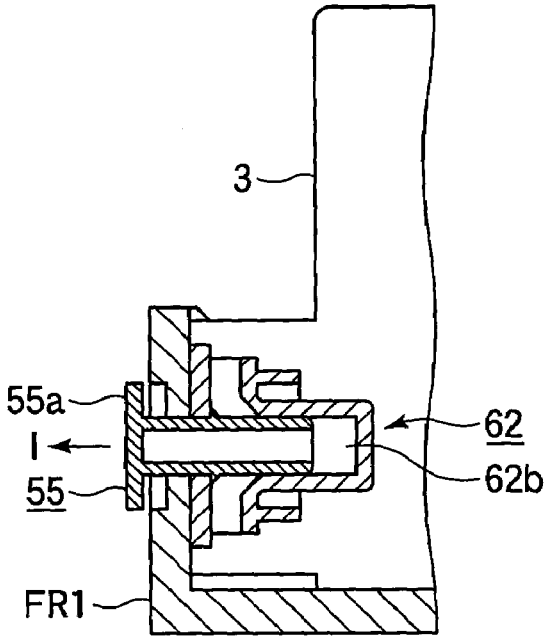
Figure 32:
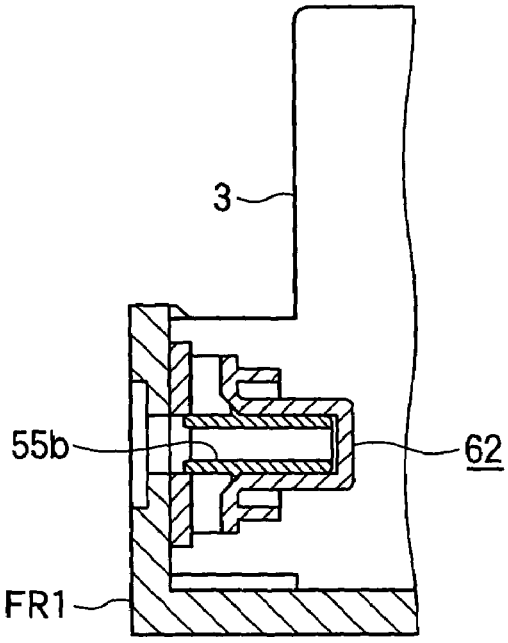

FIGS. 30-32 are cross-sectional views of the toner cartridge is detached from the developing unit.

Referring to FIG. 30, a side wall 39 of the toner cartridge 3 is formed with a hole 39*a* through which a predetermined amount of toner is filled in the toner cartridge 3. After filling the toner in the toner cartridge 3, the cap 62 is press-fitted to seal the hole 39*a*. Then, a flange 60 is fitted into the toner cartridge 3. The cap 62 includes a flange 62*c* and a hollow cylinder 62*a* that projects from the flange 62*c* and has a closed end. The cap 62 is pressed into the toner cartridge 3 until the hollow cylinder 62*a* is completely received in the hole 39*a*, thereby firmly mounting the cap 62 to the toner cartridge 3. A pin 55 is inserted into an inner space 62*b* of the hollow cylinder 62*a* after the toner cartridge 3 has been attached to the developing unit 7.

Then, the pin 55 is inserted into the inner space 62*b* of the cap 62 through the hole 61 formed in the frame FR1, the flange 60, and the hole formed in the flange 62*c*, thereby firmly coupling the toner cartridge 3 to the developing unit 7.

Because the toner cartridge 3 and developing unit 7 are interlocked by inserting the pin 55, the configuration can quickly convert the non-integral type process cartridge into the integral type process cartridge.

FIGS. 31 and 32 are cross-sectional views when the toner cartridge is detached from the developing unit.

When the toner cartridge 3 is detached from the developing unit 7, a small hole is first formed in the middle of the flange 55*a* and then a hook-like tool is inserted into the small hole. The hook-like tool is pulled so that the pin 55 comes out in a direction shown by arrow I by a predetermined distance. Then, the flange 55*a* is cut off with a cutter and the remaining cylinder 55*b* is pushed into the inner space 62*b*. Thus, the toner cartridge 3 is no longer prevented from being separated from the developing unit 7.

In the fourth embodiment, cutting off the flange 55*a* from the pin 55 brings the toner cartridge 3 and the developing unit 7 out of the interlocked relation. This makes it easy to determine whether a recovered process cartridge is of an integral type or a non-integral type.

The fourth embodiment prevents inadvertent recycling of a recovered process cartridge that is reaching the end of its lifetime.

While the present invention has been described with respect to the toner cartridge for use in an image forming section of an electrophotographic printing apparatus, the invention may also be applicable to other apparatuses such as multi-function printers, facsimile machines, and copying machines that have a similar operating lever on the cartridge side and similar guide pins on the apparatus side.

The present invention may also be applicable to a process cartridge equipped with a waste developer reservoir that collects waste developer cleaned from a photoconductive drum, and a process cartridge in which waste toner is transported with a belt or the like to a waste toner reservoir in a toner cartridge.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

a toner cartridge removably attached to the image forming apparatus, said toner cartridge holding toner in it;

wherein said toner cartridge comprises;

an operating member operated to drive a toner supplying mechanism of said toner cartridge such that the toner is supplied into the image forming apparatus;

a locking member movable either to a first position or to a second position relative to said operating member; and a receiving space that receives said locking member;

wherein when said locking member is moved from the first position to the second position, said locking member locks said toner cartridge to a part of the image forming apparatus; and wherein after said locking member is moved from the first position to the second position, said locking member remains in locking engagement with the part of the image forming apparatus regardless of operation of said operating member, and said locking member is unable to move from the second position to the first position and prevents the toner cartridge from being detached from the image forming apparatus.

2. The image forming apparatus according to claim 1, wherein the toner cartridge includes an opening;

wherein the part of the image forming apparatus is a first engagement portion that enters the opening when the toner cartridge is attached to the image forming apparatus.

3. The image forming apparatus according to claim 2, wherein when said locking member closes the opening, said locking member engages a second engagement portion of the image forming apparatus locking the toner cartridge to the first engagement portion.

4. The image forming apparatus according to claim 3, wherein said locking member includes a locking element that engages the second engagement portion so that the toner cartridge remains in locking engagement with the first engagement portion regardless of operation of said operating member after said locking member has moved to the second position.

5. The image forming apparatus according to claim 4, wherein the locking element is resilient.

6. The image forming apparatus according to claim 4, wherein when said operating member is moved to a third position, the locking element moves relative to the second engagement portion;

wherein when said operating member moves to a fourth position opposite to the third position, the locking element moves by an amount relative to the second engagement portion and is then stopped.

7. The image forming apparatus according to claim 4, wherein after said locking member has moved to the second position, said locking member is movable relative to the second engagement portion still maintaining the toner cartridge in locking engagement with the first engagement portion.

8. The image forming apparatus according to claim 1, wherein a part of said locking member is movable in said receiving space.

9. The image forming apparatus according to claim 1, wherein after said locking member is moved to the second position, said locking member blocks the part of the image forming apparatus from exiting said toner cartridge regardless of movement of said toner cartridge.

10. An image forming apparatus, comprising:

a toner cartridge removably attached to the image forming apparatus, said toner cartridge holding toner therein;

wherein said toner cartridge comprises:

an operating member operated to drive a toner supplying mechanism of said toner cartridge such that the toner is supplied into the image forming apparatus;

a locking member formed as a separate piece from said operating member and removably attached to said operating member;

a receiving space formed in said operating member and receiving said locking member; and an opening into which apart of the image forming apparatus enters when said toner cartridge is attached to the image forming apparatus;

wherein after said toner cartridge is attached to the image forming apparatus, said locking member is moved to close said opening so that the toner cartridge remains locked to the image forming apparatus.

11. The image forming apparatus according to claim 10, wherein after said locking member is moved to close said opening, said locking member remains in locking engagement with the part of the image forming apparatus regardless of movement of said toner cartridge.

12. The image forming apparatus according to claim 10, wherein after said locking member is moved to close said opening, said locking member blocks the part of the image forming apparatus from exiting said toner cartridge through the opening regardless of movement of said toner cartridge.

13. An image forming apparatus, comprising:

a toner cartridge removably attached to the image forming apparatus, said toner cartridge holding toner therein;

an operating member mounted to said toner cartridge and operated to drive a toner supplying mechanism of said toner cartridge such that the toner is supplied into the image forming apparatus; and a locking member formed as a separate piece from said operating member and removably attached to said operating member;

wherein after said toner cartridge is attached to the image forming apparatus, said locking member is moved to lock said toner cartridge to the image forming apparatus such that said toner cartridge and the image forming apparatus are unable to disengage from each other.

14. The image forming apparatus according to claim 13, wherein after said locking member is moved to lock said toner cartridge to the image forming apparatus, said locking member remains in locking engagement with a part of the image forming apparatus regardless of movement of said toner cartridge.

15. The image forming apparatus according to claim 13, wherein after said locking member is moved to lock said toner cartridge to the image forming apparatus, said locking member blocks a part of the image forming apparatus from exiting said toner cartridge regardless of movement of said toner cartridge.

* * * * *